US011028581B2

(12) United States Patent
Masia

(10) Patent No.: US 11,028,581 B2
(45) Date of Patent: Jun. 8, 2021

(54) FACE COATING FOR ACOUSTICAL MONOLITHIC CEILINGS

(71) Applicant: ARMSTRONG WORLD INDUSTRIES, INC., Lancaster, PA (US)

(72) Inventor: Steven L Masia, Lancaster, PA (US)

(73) Assignee: AWI Licensing LLC, Wilmington, DE (US)

( * ) Notice: Subject to any disclaimer, the term of this patent is extended or adjusted under 35 U.S.C. 154(b) by 0 days.

(21) Appl. No.: 16/717,736

(22) Filed: Dec. 17, 2019

(65) Prior Publication Data

US 2020/0190795 A1 Jun. 18, 2020

Related U.S. Application Data

(60) Provisional application No. 62/781,207, filed on Dec. 18, 2018.

(51) Int. Cl.

| | |
|---|---|
| ***E04B 1/82*** | (2006.01) |
| ***E04B 9/00*** | (2006.01) |
| ***E04B 1/86*** | (2006.01) |
| ***E04B 9/04*** | (2006.01) |

(52) U.S. Cl.

CPC ..... *E04B 9/001* (2013.01); *E04B 1/86* (2013.01); *E04B 9/04* (2013.01)

(58) Field of Classification Search

CPC ... E04B 9/04; E04B 9/001; E04B 9/00; E04B 1/86; E04B 9/0435; E04B 9/241; E04B 9/28; E04B 2001/8461; B32B 27/00; B29C 51/14

USPC ..... 52/144, 145; 181/290, 291; 156/280, 156/279; 428/323, 426, 428, 432

See application file for complete search history.

(56) References Cited

U.S. PATENT DOCUMENTS

| | | | | |
|---|---|---|---|---|
| 7,033,963 | B2 * | 4/2006 | Felegi, Jr. | C09D 7/61 442/44 |
| 7,798,287 | B1 * | 9/2010 | Surace | E04B 9/0464 181/290 |
| 7,878,301 | B2 * | 2/2011 | Gross | D06M 15/643 181/290 |
| 7,879,433 | B1 * | 2/2011 | Felegi, Jr. | E04B 1/86 428/143 |
| 2003/0154679 | A1 * | 8/2003 | Swiszcz | E04B 9/045 52/506.07 |
| 2004/0062898 | A1 * | 4/2004 | Felegi, Jr. | C09D 7/69 428/44 |
| 2007/0055012 | A1 * | 3/2007 | Caldwell | C09D 7/61 525/54.1 |

(Continued)

FOREIGN PATENT DOCUMENTS

| | | |
|---|---|---|
| EP | 0403573 B1 | 7/1992 |

*Primary Examiner* — Chi Q Nguyen
(74) *Attorney, Agent, or Firm* — Craig M. Sterner

(57) ABSTRACT

Described herein is a coated acoustic building material comprising a body comprising a first major surface opposite a second major surface; a coating having an upper surface opposite a lower surface, the lower surface of the coating facing the first major surface of the body, the coating comprising: polymeric binder having a glass transition temperature less than 0° C.; and a filler; wherein the coating is present as coalesced particles atop the first major surface in an amount ranging from about 210 g/m$^2$ to about 1,300 g/m$^2$.

20 Claims, 11 Drawing Sheets

(56) References Cited

U.S. PATENT DOCUMENTS

| | | | | |
|---|---|---|---|---|
| 2010/0066121 | A1* | 3/2010 | Gross | G10K 11/162 296/146.5 |
| 2013/0316083 | A1 | 11/2013 | French et al. | |
| 2014/0044897 | A1* | 2/2014 | Zhou | B41M 5/506 428/32.22 |
| 2014/0124291 | A1* | 5/2014 | Dugan | E04C 2/043 181/290 |
| 2017/0121964 | A1* | 5/2017 | Wiker | E04B 9/067 |
| 2018/0179754 | A1* | 6/2018 | Karnicki | B32B 15/20 |
| 2020/0002941 | A1* | 1/2020 | Oleske | E04B 9/001 |

* cited by examiner

FACE COATING FOR ACOUSTICAL MONOLITHIC CEILINGS

CROSS-REFERENCE TO RELATED APPLICATIONS

This application claims the benefit of U.S. Provisional Application No. 62/781,207, filed on Dec. 18, 2018. The disclosure of the above application is incorporated herein by reference.

BACKGROUND

Ceiling systems are installed into room environments to help control noise as well as enhance the aesthetic appeal of those room environments. These ceiling systems may comprise one or more building panels having specific aesthetic properties that help contribute to the appeal of the room environment. Previous attempts at improving these aesthetic properties included applying facing sheets and/or paint to the building panels. However, seams may still exist between adjacent facing sheets, thereby leaving the ceiling with a less than ideal aesthetic appeal. Additionally, paint may be applied across multiple building panels, however, such paint restrictions air from flowing into and through the building panel—thereby degrading acoustical performing of the resulting ceiling system. Thus, a need exists for a decorative coating that may form part of a ceiling system that can impart the desired aesthetic appeal without sacrificing the necessary airflow for the ceiling system to provide the desired acoustical properties.

BRIEF SUMMARY

According to some embodiments, a coated acoustic building material comprising: a body comprising a first major surface opposite a second major surface; a coating having an upper surface opposite a lower surface, the lower surface of the coating facing the first major surface of the body, the coating comprising: polymeric binder having a glass transition temperature less than 0° C.; and a filler, wherein the coating is present as coalesced particles atop the first major surface in an amount ranging from about 20 g/ft$^2$ to about 120 g/ft$^2$.

In other embodiments, the present invention includes a coating composition comprising: a polymeric binder having a glass transition temperature less than 0° C.; a filler; and a liquid carrier; wherein the polymeric binder is present in an amount ranging from about 3 wt. % to about 8 wt. % based on the total weight of coating composition.

Other embodiments of the present invention include a method of forming a coated acoustic building material comprising: a) applying spray pressure to a liquid coating composition of at least 40 psi, the liquid coating composition comprising a liquid carrier, a pigment, and a polymeric binder having a glass transition temperature less than 0° C.; b) driving off the liquid carrier from the liquid coating composition to at least partially coalesce the polymeric binder onto the pigment; c) subsequently contacting the particles with a major surface of a building material to for a coating atop the major surface of the building material.

In other embodiments, the present invention includes an acoustic building system comprising: a first building panel comprising a first major surface defined by a first perimeter, and a second building panel comprising a second major surface defined by a second perimeter, at least a first portion of the first perimeter being immediately adjacent to a second portion of the second perimeter, whereby a seam exists between the first portion and the second portion; a coating applied to the first major surface and the second major surface such that the coating covers at least a portion of the seam; wherein the coating comprises polymeric binder having a glass transition temperature less than 0° C. and a filler, and wherein the coating is present as coalesced particles atop the first major surface in an amount ranging from about 20 g/ft$^2$ to about 120 g/ft$^2$.

In other embodiments, the present invention includes a coated acoustic building material comprising: a non-woven layer having an upper surface opposite a lower surface; a coating having an upper surface opposite a lower surface, the lower surface of the coating facing the upper surface of the non-woven layer, the coating comprising: polymeric binder having a glass transition temperature less than 0° C.; and a filler; wherein the coating is present as coalesced particles atop the upper surface of the non-woven layer and an airflow resistance ranges from about 40 mks rayls to about 7,500 mks rayls as measured between the lower surface of the non-woven layer and the upper surface of the coating.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
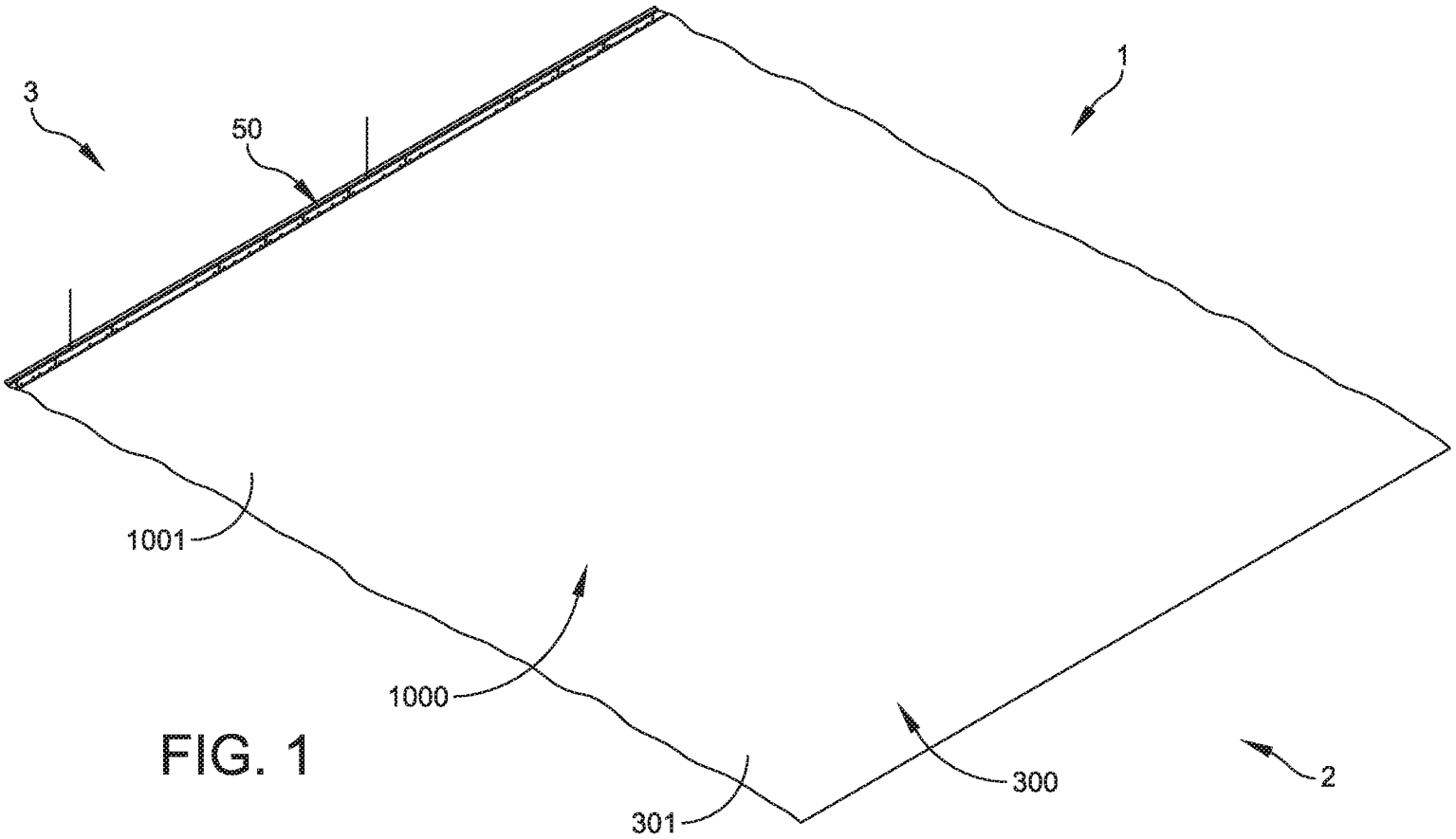
FIG. 1 is perspective view of a building system having a monolithic face according to the present invention.

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top," and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such.

Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Unless otherwise specified, all percentages and amounts expressed herein and elsewhere in the specification should be understood to refer to percentages by weight. The amounts given are based on the active weight of the material. According to the present application, the term "about" means +/−5% of the reference value. According to the present application, the term "substantially free" less than about 0.1 wt. % based on the total of the referenced value.

Referring to FIG. 1, the building system 1 of the present invention may comprise an acoustical monolithic structure 1000 (herein also referred to as "monolithic structure") having an exposed major surface 1001 (also referred to herein as "monolithic surface" 1001). The term "monolithic" refers to uniform and continuous structure—i.e., uninterrupted. As discussed in greater detail herein, the overall monolithic structure 1000 of the present invention may be formed from a combination of multiple separate components. The resulting monolithic structure 1000 may still constitute as monolithic because, in combination, at least portions of the components form a continuous and uninterrupted structure. Therefore, the term "monolithic structure" according to the present invention may not require that the entire structure be uniform and continuous so long as at least a portion of the structure is uniform and continuous.

The monolithic structure may be supported by a support structure 50. Non-limiting examples of support structures include suspended ceiling grids, wall-studs (also called framing studs), and structural walls (e.g., ceiling formed by an adjacent subfloor in a multi-floor building, roof). In the exemplified embodiment, the support structure 50 is a suspending ceiling grid.

The support grid 50 may comprise a plurality of first support struts 51 that are substantially parallel to each other. The support grid 50 may comprise a plurality of second support struts 52 that are substantially parallel to each other. The first support struts 51 may be arranged perpendicular to the second support struts 52. Each of the support struts 51, 52 may independently comprise an inverted T-bar having a horizontal flange 57 and a vertical web 58. The plurality of second support struts 52 may intersect the plurality of first support struts 51 to create the support grid 50—whereby the support grid 50 comprises a plurality of grid openings 54 located between the intersecting first and second support struts 51, 52.

The building system 1 may be installed in an interior space, whereby the interior space comprises a plenary space 3 and an active room environment 2. The plenary space 3 provides space for mechanical lines within a building (e.g., HVAC, plumbing, etc.). The active space 2 provides room for the building occupants during normal intended use of the building (e.g., in an office building, the active space would be occupied by offices containing computers, lamps, etc.).

The plenary space 3 may exist above the support grid 50 and the active room environment 2 may exist below the support grid 50. The exposed major surface 1001 may face the active room environment 2. The exposed major surface 1001 of the acoustical monolithic structure 1000 may be visible from the active room environment 2.

Figure 2:
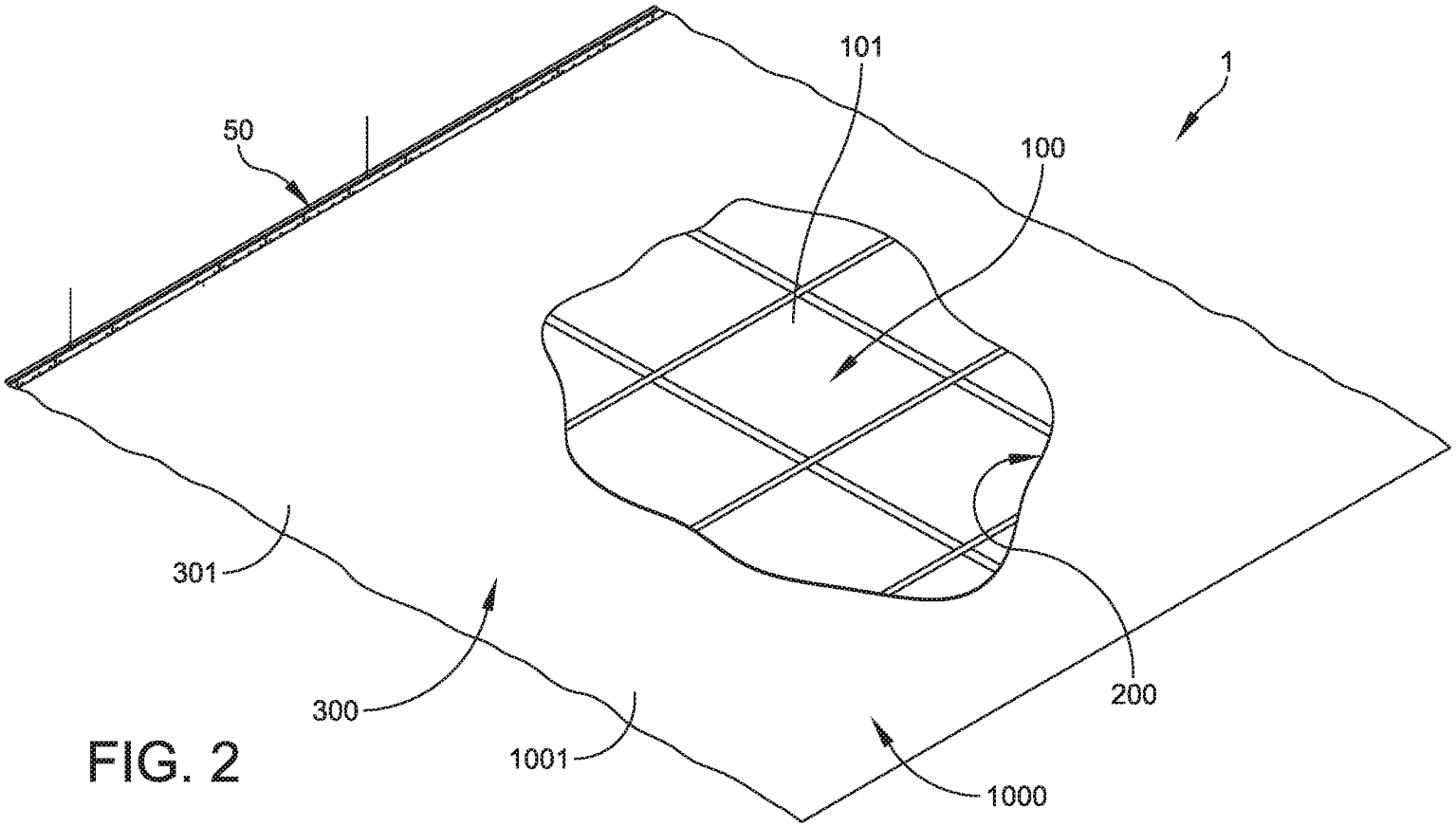
FIG. 2 is perspective view of the building system of FIG. 1 with a cutaway view according to the present invention.
Figure 3:
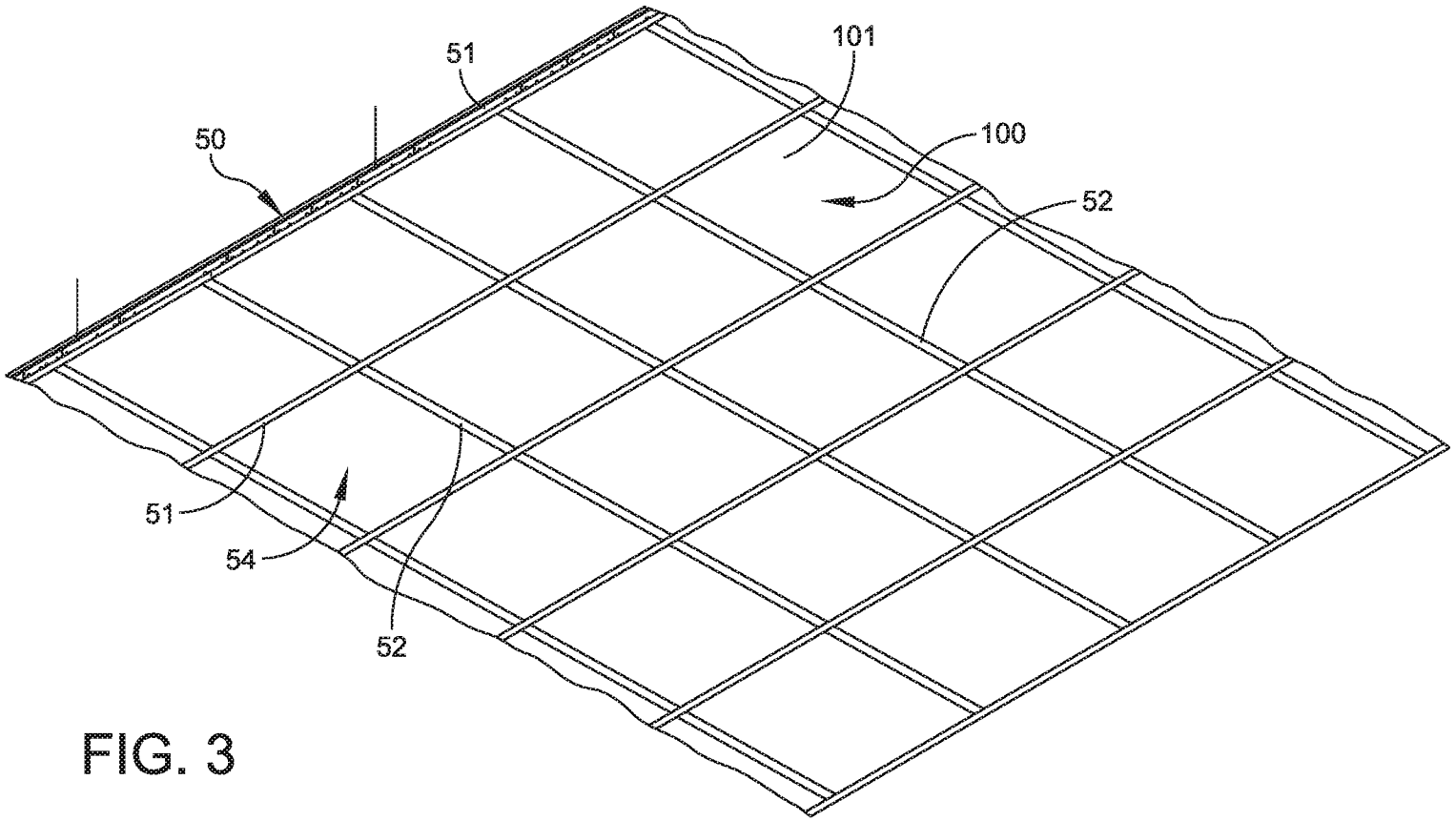
FIG. 3 is perspective view of a support grid comprising building panels according to the present invention.
Figure 4:
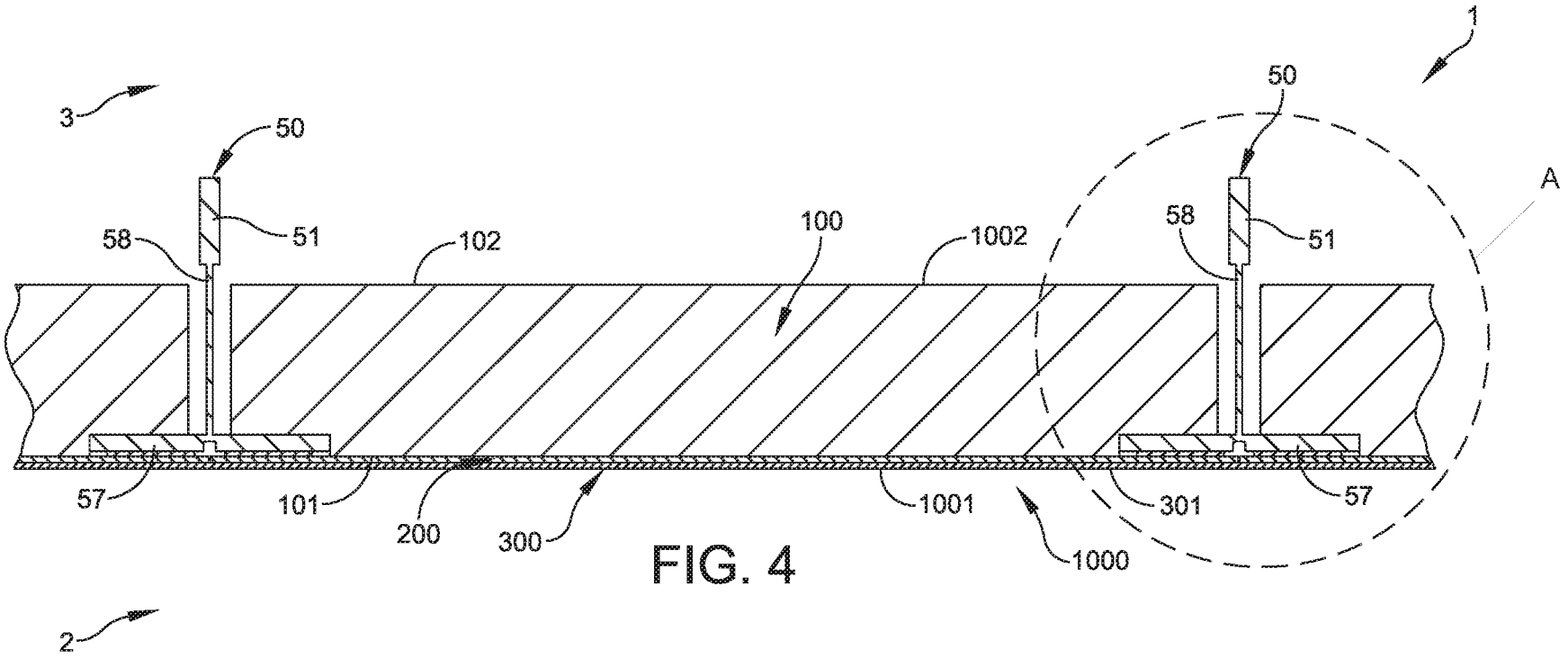
FIG. 4 is a cross-sectional view of the building system of FIG. 1 along line 6-6 of FIG. 1.
Figure 9:
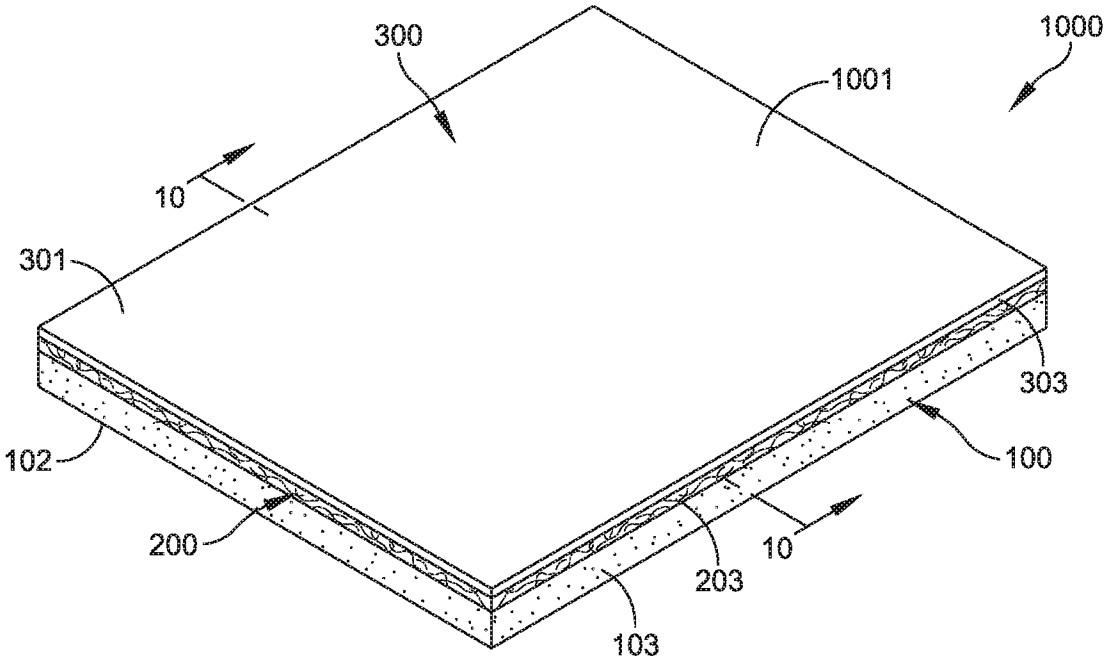
FIG. 9 is a building material comprising an acoustic coating atop the facing layer and panel body of FIG. 7.

Referring now to FIG. 9, the monolithic structure 1000 of the present invention may comprise at least one panel body 100 and an acoustical coating 300 (herein referred to as "coating") applied thereto. Referring now to FIGS. 2 and 4, the monolithic structure 1000 of the present invention may comprise a plurality of panel bodies 100 and an acoustical coating 300 (herein referred to as "coating") applied thereto. As described further herein, the monolithic structure 1000 of the present invention may comprise at least one panel body 100, an acoustical coating 300, and at least one facing layer 200 positioned between the panel body 100 and the coating 300. As described further herein, the monolithic structure 1000 of the present invention may comprise a plurality of panel bodies 100, an acoustical coating 300, and at least one facing layer 200 positioned between the panel bodies 100 and the coating 300.

Figure 6:
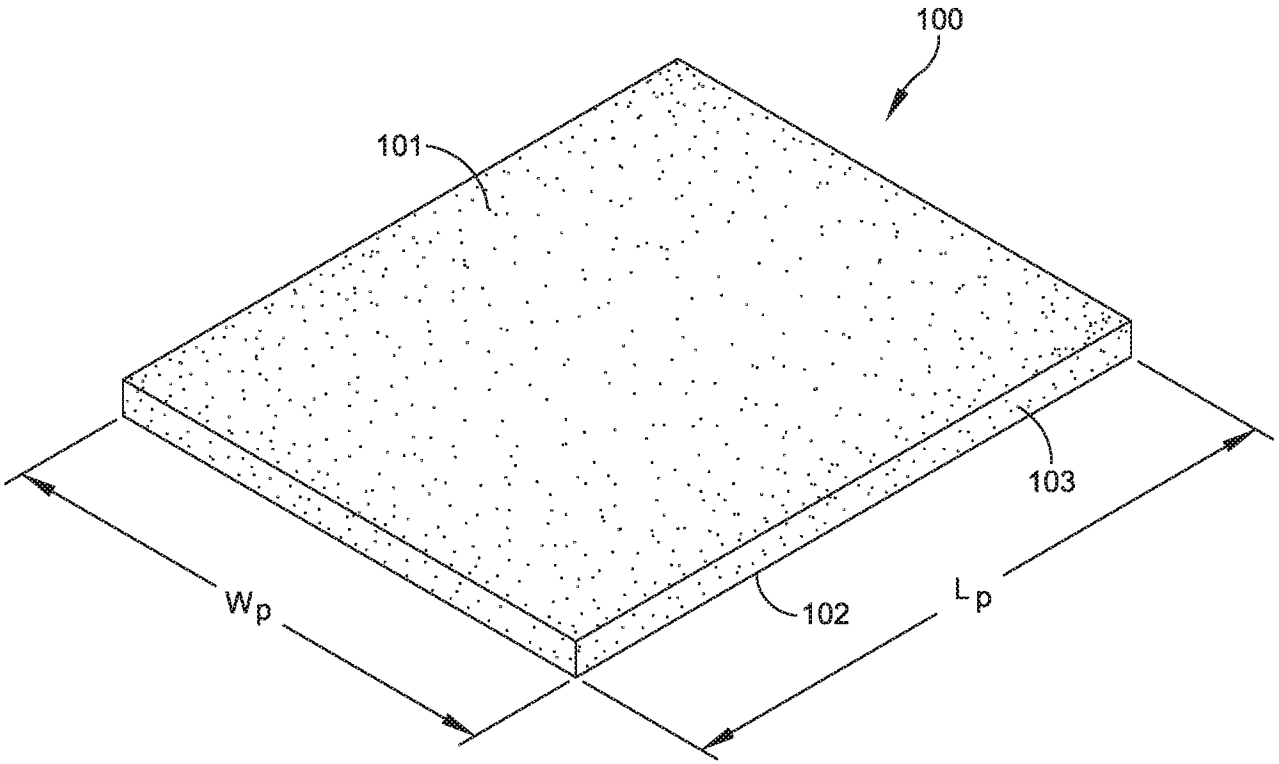
FIG. 6 is a perspective view of a panel body according to the present invention.
Figure 8:
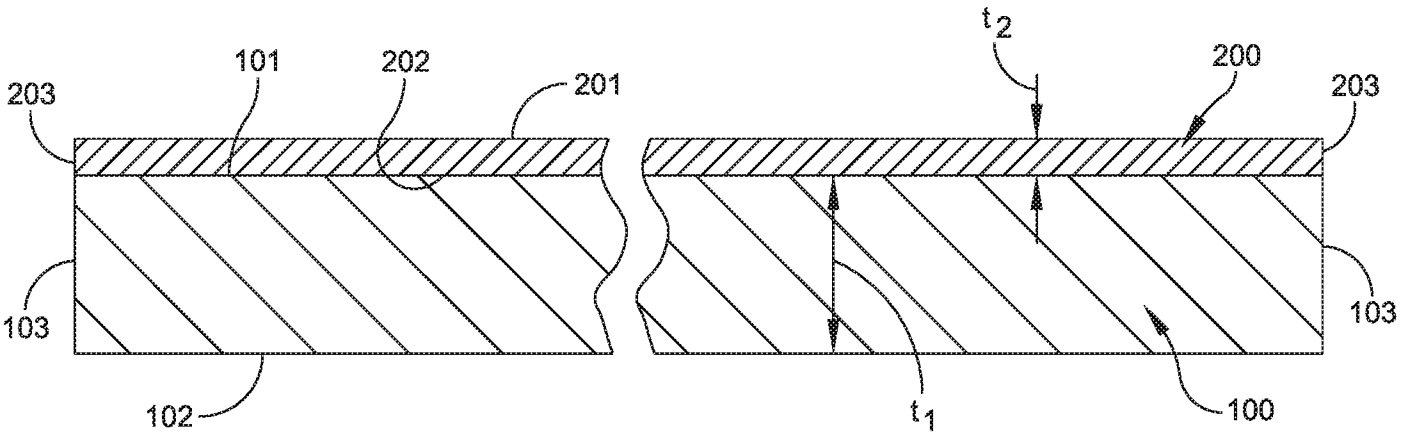
FIG. 8 is a cross-sectional view of the facing layer atop the panel body of FIG. 7 along line 8-8.

Referring now to FIGS. 6 and 8, the panel body 100 may comprise a first major surface 101 opposite a second major surface 102 and side surfaces 103 extending between the first and second major surfaces 101, 102. The side surfaces 103 may define a perimeter of the panel body 100. The panel body 100 may have a body thickness ti that extends from the first major surface 101 to the second major surface 102 of the panel body 100. The body thickness ti may range from about 12 mm to about 40 mm—including all values and sub-ranges there-between. The panel body 100 may have a length $L_P$ ranging from about 30 cm to about 310 cm—including all values and sub-ranges there-between. The panel body 100 may have a width $W_P$ ranging from about 10 cm to about 125 cm—including all values and sub-ranges there-between.

The panel body 100 may be comprised of a binder and fibers. In some embodiments, the panel body 100 may further comprise a filler and/or additive. Non-limiting examples of binder may include a starch-based polymer, polyvinyl alcohol (PVOH), a latex, polysaccharide polymers, cellulosic polymers, protein solution polymers, an acrylic polymer, polymaleic anhydride, epoxy resins, or a combination of two or more thereof. Non-limiting examples of filler may include powders of calcium carbonate, limestone, titanium dioxide, sand, barium sulfate, clay, mica, dolomite, silica, talc, perlite, polymers, gypsum, wollastonite, expanded-perlite, calcite, aluminum trihydrate, pigments, zinc oxide, or zinc sulfate.

The fibers may be organic fibers, inorganic fibers, or a blend thereof. Non-limiting examples of inorganic fibers mineral wool (also referred to as slag wool), rock wool, stone wool, and glass fibers. Non-limiting examples of organic fiber include fiberglass, cellulosic fibers (e.g. paper fiber—such as newspaper, hemp fiber, jute fiber, flax fiber, wood fiber, or other natural fibers), polymer fibers (including polyester, polyethylene, aramid—i.e., aromatic polyamide, and/or polypropylene), protein fibers (e.g., sheep wool), and combinations thereof.

Non-limiting examples of binder may include a starch-based polymer, polyvinyl alcohol (PVOH), a latex, polysaccharide polymers, cellulosic polymers, protein solution polymers, an acrylic polymer, polymaleic anhydride, epoxy resins, or a combination of two or more thereof. Non-limiting examples of filler may include powders of calcium carbonate, limestone, titanium dioxide, hollow spheres, sand, barium sulfate, clay, mica, dolomite, silica, talc, perlite, polymers, gypsum, wollastonite, expanded-perlite, calcite, aluminum trihydrate, pigments, zinc oxide, or zinc sulfate.

Although not pictured, the panel body 100 may have an inner core that comprises a honeycomb structure. The honeycomb structure may be formed from a plurality of interconnected cell walls that define a plurality of open cells. The cell walls are oriented perpendicular to the first and second major surfaces of the panel body 100 and extend vertically between the top and bottom surfaces. Any suitable shape of cells (in top plan view) may be used, including hexagon, triangular, square, circular, etc. as some non-limiting examples.

The core of the honeycomb panel body 100 may be formed by paper cell walls. Paper used to construct cell walls may be at least 20-pound kraft paper, and in some embodiments 20 to 80-pound kraft paper (thicknesses of about 0.004 to 0.015 inches) which generally provides the requisite stiffness to the core to resist sagging of the ceiling panel without unduly adding weight to the ceiling panel structure. As opposed to other materials, paper is generally more economical and cost-effective as a core wall material. The paper may be resin-impregnated in some embodiments. In other possible embodiments, lightweight non-paper material such as fiberglass and thin aluminum metal sheet also may perform satisfactorily for cell walls and be used. Non-woven materials, such as for example without limitation non-woven glass fibers in a resin matrix, may also be used—as discussed further herein.

The panel body 100 may be porous, thereby allowing airflow through the panel body 100 between the first major surface 101 and the second major surface 102 of the panel body 100. According to the present invention, the term porous refers to the panel body 120 being porous enough to allow for enough airflow through the panel body 100 (under atmospheric conditions) for the panel body 100 and the resulting monolithic structure 1000 to function as an acoustic panel body 100 and corresponding acoustic monolithic structure 100, which requires properties related to noise reduction and sound attenuation properties—as discussed further herein.

Specifically, the panel body 100 of the present invention may have a porosity ranging from about 60% to about 98%—including all values and sub-ranges there between. In a preferred embodiment, the panel body 100 has a porosity ranging from about 75% to 95%—including all values and sub-ranges there between.

According to the embodiments where the panel body 100 is formed from binder and fibers, porosity may be calculated by the following:

$$\%\ \text{Porosity}=[V_{Total}-(V_{Binder}+V_F+V_{HC}+V_{Filler})]/V_{Total}$$

Where $V_{Total}$ refers to the total volume of the panel body 100 defined by the first major surface 101, the second major surface 102, and the side surfaces 103 of the panel body 100. $V_{Binder}$ refers to the total volume occupied by the binder in the body 120. $V_F$ refers to the total volume occupied by the fibers in the panel body 100. $V_{Filler}$ refers to the total volume occupied by the filler in the panel body 100. $V_{HC}$ refers to the total volume occupied by the hydrophobic component in the panel body 100. Thus, the % porosity represents the amount of free volume within the panel body 100.

The panel body 100 of the present invention may exhibit sufficient airflow for the panel body 100 to have the ability to reduce the amount of reflected sound in an active room environment 2. The reduction in amount of reflected sound in an active room environment 2 is expressed by a Noise Reduction Coefficient (NRC) rating as described in American Society for Testing and Materials (ASTM) test method C423. This rating is the average of sound absorption coefficients at four ⅓ octave bands (250, 500, 1000, and 2000 Hz), where, for example, a system having an NRC of 0.90 has about 90% of the absorbing ability of an ideal absorber. A higher NRC value indicates that the material provides better sound absorption and reduced sound reflection.

The panel body 100 of the present invention exhibits an NRC of at least about 0.5. In a preferred embodiment, the panel body 100 of the present invention may have an NRC ranging from about 0.60 to about 0.99—including all value and sub-ranges there-between.

In addition to reducing the amount of reflected sound in a single active room environment 2, the panel body 100 of the present invention may also be able to exhibit superior sound attenuation—which is a measure of the sound reduction between an active room environment 2 and a plenary space 3. The ASTM has developed test method E1414 to standardize the measurement of airborne sound attenuation between room environments 2 sharing a common plenary space 3. The rating derived from this measurement standard is known as the Ceiling Attenuation Class (CAC). Ceiling materials and systems having higher CAC values have a greater ability to reduce sound transmission through the plenary space 3—i.e. sound attenuation function.

The panel body 100 of the present invention may exhibit a CAC value of 30 or greater, preferably 35 or greater.

Figure 7:
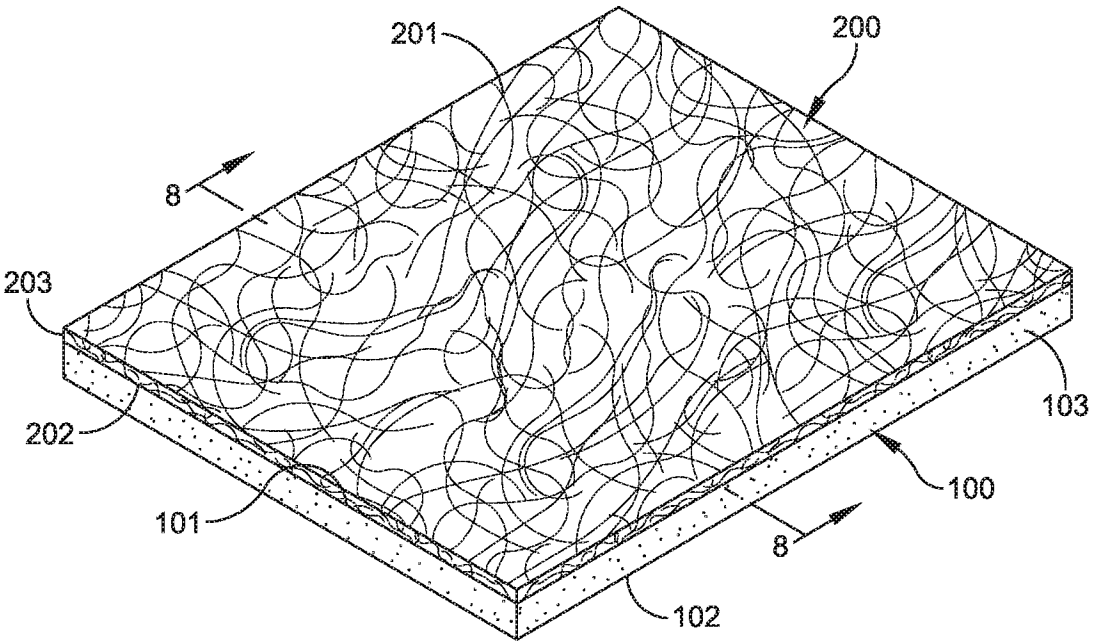
FIG. 7 is a perspective view of a facing layer atop the panel body of FIG. 6.

Referring now to FIGS. 7 and 8, the facing layer 200 may comprise a first major surface 201 that is opposite a second major surface 202 and side surfaces 203 extending between the first and second major surfaces 201, 202 of the facing layer 200. The side surfaces 203 may define a perimeter of the facing layer 200. The facing layer 200 may have a layer thickness t2 as measured by the distance between the first major surface 201 and the second major surface 202 of the facing layer 200. The layer thickness t2 may range from about 100 μm to about 10,000 μm—including all values and sub-ranges there-between. The facing layer 200 may have a length ranging from about 50% to about 400% of length $L_P$ of the panel body 100—including all values and sub-ranges there-between. The facing layer 200 may have a width ranging from about 50% to about 400% of the width $W_P$ of the panel body 100—including all values and sub-ranges there-between.

The facing layer 200 may be formed from a non-woven fibrous material. In a non-limiting example, the facing layer 200 may be a non-woven scrim formed from fibrous material. Fibrous material may be organic fibers, inorganic fibers, or a blend thereof.

Non-limiting examples of inorganic fibers mineral wool (also referred to as slag wool), rock wool, stone wool, and glass fibers (i.e., "fiberglass"). Non-limiting examples of organic fiber include fiberglass, cellulosic fibers (e.g. paper fiber—such as newspaper, hemp fiber, jute fiber, flax fiber, wood fiber, or other natural fibers), polymer fibers (including polyester, polyethylene, aramid—i.e., aromatic polyamide, and/or polypropylene), protein fibers (e.g., sheep wool), and combinations thereof. In a preferred embodiment, the facing layer 200 is formed from fiberglass.

The facing layer 200 may be porous, thereby allowing airflow through the fibrous layer 200 between the first major surface 201 and the second major surface 202 of the facing layer 200. The facing layer 200 of the present invention may exhibit sufficient airflow for the facing layer 200 to not substantially interfere with the acoustic properties of the panel body 100. According to some embodiments, the facing layer 200 may have an air flow resistance ranging from about 40 mks rayls to about 8,000 mks rayls—including all airflow resistances and sub-ranges there-between. In a preferred embodiment, the facing layer 200 may have an air flow resistance ranging from about 100 mks rayls to about 7,500 mks rayls—including all airflow resistances and sub-ranges there-between As demonstrated by FIG. 9, the first major surface 101 of the panel body 100 may face the second major surface 202 of the facing layer 200. In some embodiments, the first major surface 101 of the panel body 100 may contact the second major surface 202 of the facing layer 200. In some embodiments, the first major surface 101 of the panel body 100 may be in direct and substantially continuous contact the second major surface 202 of the facing layer 200.

For the panel bodies comprising a honeycomb core, the core may be sandwiched between a first facing layer and a second facing layer. The first and/or second facing layer may be adhesively bonded to first and/or second major surfaces of the panel body.

Referring now to FIGS. 4, 5, 9 and 10, the monolithic structure 1000 of the present invention further comprises an acoustic coating 300 applied atop the panel body 100 and facing layer 200. Specifically, the acoustic coating 300 is applied to the first major surface 201 of the facing layer 200.

The coating 300 may comprise an upper surface 301 that is opposite a lower surface 302. The coating may have a side surface 303 that extends between the upper surface 301 and the lower surface 302. The coating 300 may have a coating thickness t3 that ranges from about 10 μm to about 1,000 μm—including all thicknesses and sub-ranges there-between. The sum layer thickness t2 and the coating thickness t3 may range from about 10 μm to about 11,000 μm—including all thickness and sub-ranges there-between.

The coating 300 may be a color surface coating 300. According to the present invention the terms "color surface coating" and "acoustic coating" and "coating" may be used interchangeably. The term "color surface coating" refers to a coating 300 comprising a color pigment and the resulting coating 300 exhibits a color on the visible color spectrum—e.g., violet, blue, green, yellow, orange, or red. In other non-limiting examples, the coating 300 may also have a color of white, black, or grey. The color surface coating 300 may further comprise combinations of two or more colors—such a primary color (i.e., red, yellow, blue) as well as an achromatic color (i.e., white, grey).

Figure 10:
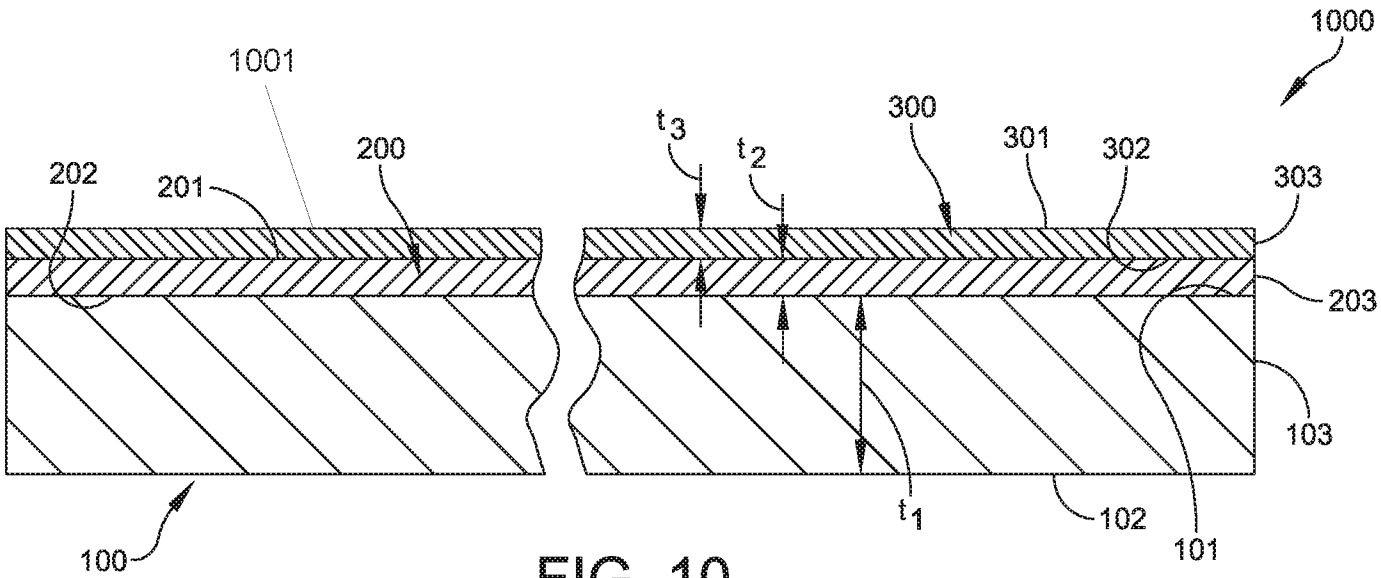
FIG. 10 is a cross-sectional view of the building material of FIG. 9.

As shown in FIGS. 9 and 10, the coating 300 may be applied to the first major surface 201 of the facing layer 200. The lower surface 302 of the coating 300 may be in direct contact with the first major surface 201 of the facing layer 200. The coating 300 may form at least a portion of the exposed major surface 1001 of the monolithic structure 1000—i.e., the exposed surface 1001 of the monolithic structure 1000 may comprise the coating 300. Specifically, the upper surface 301 of coating 300 may form at least a portion of the exposed major surface 1001 of the monolithic structure 100. The exposed surface 1001 of the monolithic structure 1000 may comprise the upper surface 301 of the coating 300.

Figure 11:
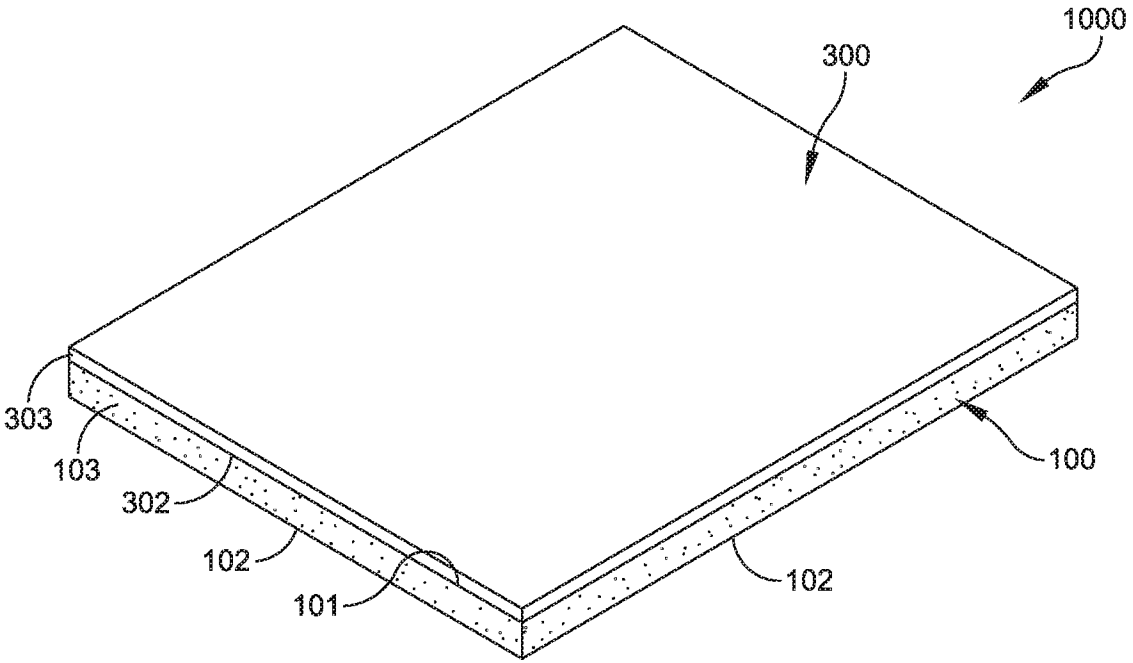
FIG. 11 is a building material according to an alternative embodiment.

As shown in FIG. 11, according to an alternative embodiment, the coating 300 may be applied directly to the first major surface 101 of the panel body 100. In such embodiments, the lower surface 302 of the coating 300 may be in direct contact with the first major surface 101 of the panel body 100. Also in such embodiments, the upper surface 301 of the coating 300 may form at least a portion of the exposed major surface 1001 of the monolithic structure 1000—i.e., the exposed surface 1001 of the monolithic structure 1000 may comprise the coating 300. Specifically, the exposed surface 1001 of the monolithic structure 1000 may comprise the upper surface 301 of the coating 300.

The coating 300 may comprise a binder and a filler. The coating 300, in the dry-state, may be present on the first major surface 201 of the facing layer 200 in an amount ranging from about 210 g/m$^2$ to about 1,300 g/m$^2$—including all amounts and sub-ranges there-between. In a preferred embodiment, the coating 300, in the dry-state, may be present on the first major surface 201 of the facing layer 200 in an amount ranging from about 210 g/m$^2$ to about 860 g/m$^2$—including all amounts and sub-ranges there-between. According to the present invention, the phrase "dry-state" indicates a composition that is substantially free of a liquid carrier (e.g., liquid water). In a preferred embodiment, the coating 300 in the dry-state has a solid's content of about 100 wt. % based on the total weight of the coating 300. Conversely, a composition that is in a "wet-state," which refers to a composition containing various amounts of liquid carrier—as discussed further herein.

The coating 300 in the dry-state may comprise the binder and filler and less than about 0.1 wt. % of liquid carrier based on the total weight of the coating 300. Similar to the phrase "dry-state"—the phrase "dry-weight" refers to the weight of a component or composition without including any additional weight of liquid carrier. Thus, when calculating the dry weight of a component or composition, the calculation should be based solely on the weight of the solid components (e.g., dispersant, pigment, binder, etc.), and should exclude any amount of residual liquid carrier that may still be present from the wet-state.

The binder may be present in the coating 300 in an amount ranging from about 1 wt. % to about 10 wt. % based on the total dry-weight of the coating 300 including all wt. % and sub-ranges there-between. In some embodiments, the binder may be present in the coating 300 in an amount ranging from about 1 wt. % to about 8 wt. % based on the total dry-weight of the coating 300 including all wt. % and sub-ranges there-between. In a preferred embodiment, the binder may be present in the coating 300 in an amount ranging from about 3 wt. % to about 7 wt. % based on the total dry-weight of the coating 300—including all wt. % and sub-ranges there-between.

The binder may be polymeric. The binder may have a glass transition temperature ("Tg") that is less than room temperature ("Tm")—wherein room temperature ranges from about 21° C. In a preferred embodiment, the binder may have a Tg that is less than about 0° C. The binder may have a Tg that is less than about −1° C. The binder may have a Tg that is less than about −5° C. The binder may have a Tg that is less than or equal to about −10° C. The binder may have a. Tg that is less than or equal to about −15° C. The binder may have a Tg that is less than or equal to about −16° C. The binder may have a Tg that is less than or equal to about −17° C. The binder may have a Tg that is less than or equal to about −18° C. The binder may have a Tg that is less than or equal to about −19° C. The binder may have a Tg that is less than or equal to about −20° C. The binder may have a Tg that is less than or equal to about −21° C. In a preferred embodiment, the binder may have a Tg that is less than or equal to about −22° C. According to some embodiments, the binder may have a Tg that is less than or equal to about −30° C. According to some embodiments, the binder may have a Tg that is less than or equal to about −40° C. According to some embodiments, the binder may have a Tg that is less than or equal to about −48° C.

The polymeric binder may have a minimum film formation temperature ("MFFT") of less than about 10° C. The MFFT refers to the temperature at which a polymeric binder will uniformly coalesce when laid on a substrate as a thin film. In a preferred embodiment, the binder may have a MFFT that is less than about 5° C. The binder may have a MFFT that is less than about 4° C. The binder may have a MFFT that is less than about 3° C. The binder may have a MFFT that is less than or equal to about 2° C. The binder may have a MFFT that is less than or equal to about 1° C. The binder may have a MFFT that is less than or equal to about 0° C. The binder may have a MFFT that is less than or equal to about −1° C.

Non-limiting examples of the first binder include polymers selected from polyvinyl alcohol (PVOH), latex, an acrylic polymer, polymaleic anhydride, or a combination of two or more thereof. Non-limiting examples of latex binder may include a homopolymer or copolymer formed from the following monomers: vinyl acetate (i.e., polyvinyl acetate), vinyl propinoate, vinyl butyrate, ethylene, vinyl chloride, vinylidene chloride, vinyl fluoride, vinylidene fluoride, ethyl acrylate, methyl acrylate, propyl acrylate, butyl acrylate, ethyl methacrylate, methyl methacrylate, butyl methacrylate, hydroxyethyl methacrylate, hydroxyethyl acrylate, styrene, butadiene, urethane, epoxy, melamine, and an ester. Preferably the binder is selected from the group consisting of aqueous lattices of polyvinyl acetate, polyvinyl acrylic, polyurethane, polyurethane acrylic, polystyrene acrylic, epoxy, polyethylene vinyl chloride, polyvinylidene chloride, and polyvinyl chloride.

The filler may be present in the coating 300 in an amount ranging about 80 wt. % to about 99 wt. % based on the total dry-weight of the coating 300—including all wt. % and sub-ranges there-between. In some embodiments, the filler may be present in the coating 300 in an amount ranging from about 85 wt. % to about 95 wt. % based on the total dry-weight of the coating 300—including all wt. % and sub-ranges there-between. In a preferred embodiment, the filler may be present in the coating 300 in an amount ranging from about 87 wt. % to about 93 wt. % based on the total dry-weight of the coating 300—including all wt. % and sub-ranges there-between.

The filler may comprise at least one of microfibers, various inorganic and/or organic powders, and/or pigments. Non-limiting examples of powders include calcium carbonate, limestone, titanium dioxide, sand, barium sulfate, clay, mica, dolomite, silica, talc, perlite, polymers, gypsum, wollastonite, expanded-perlite, calcite, aluminum trihydrate, pigments, zinc oxide, or zinc sulfate. The pigment may be an inorganic pigment. Non-limiting examples of inorganic pigment include particles of carbon black, graphite, graphene, copper oxide, iron oxide, zinc oxide, calcium carbonate, manganese oxide, titanium dioxide and combinations thereof. The inorganic pigments may include individual particles having colors selected from, but not limited to, red, blue, yellow, black, green, brown, violet, white, grey and combinations thereof. The particles that make up the first pigment may have a particle size ranging from about 15 nm to about 1000 μm—including all sizes and sub-ranges there-between.

Non-limiting examples of microfibers include fiberglass, mineral wool, cellulosic, crosslinked starch, polymer. The term "microfiber" refers to a fibrous material having a diameter of less than about 50 μm—preferably less than about 30 μm.

The coating 300 of the present invention may be formed from a coating composition comprising the binder, filler, and a liquid carrier. The liquid carrier may be selected from water, VOC solvent—such as acetone, toluene, methyl acetate—or combinations thereof. In a preferred embodiment, the liquid carrier is water and comprises less than 1 wt. % of VOC solvent based on the total weight of the liquid carrier.

The liquid carrier may be present in the coating composition in an amount ranging from about 15 wt. % to about 35 wt. % based on the total wet-weight of the coating composition—including all wt. % and sub-ranges there-between. The phrase "wet-weight" refers to the weight of a component or composition with any additional weight of liquid carrier. Thus, when calculating the wet-weight of a component or composition, the calculation should be based on the weight of the solid components (e.g., dispersant, pigment, binder, etc.) as well as the weight of the liquid carrier.

The solids content of the coating composition may range from about 65 wt. % to about 85 wt. %—including all wt. % and sub-ranges there-between. In a preferred embodiment, the solids content of the coating composition may range from about 70 wt. % to about 80 wt. % based on the total weight of the face coating composition—including all wt. % and sub-ranges there-between. In some embodiments, the coating composition may have a solids content of at least 75 wt. % based on the total wet-weight of the coating composition. In some embodiments, the coating composition may have a solids content of at least 77 wt. % based on the total wet-weight of the coating composition. The coating composition having a solid's content of greater than about 74 wt. % solid may require the addition of a humectant and/or dispersant to allow for uniform spray application without premature dewatering or premature clumping.

The solid's content is calculated as the fraction of materials present in the coating composition that are not the liquid carrier. Specifically, the solid's content of the coating composition may be calculated as the amount of binder, filler, any additives (e.g., dispersant, coalescing agent) in the coating composition and dividing it by the total weight of the coating composition (including liquid carrier).

Therefore, the amount of each component in the coating composition may be calculated by multiplying the desired amount of each of the binder and filler present in the coating 300 in the dry-state by the total solids content of the face coating composition. For example, for a coating 300 in the dry-state comprising about 60 wt. % of pigment, whereby that coatting 300 is formed from a coating composition having a solids content of 15 wt. %—the amount of the pigment in the face coating composition would be 9 wt. % based on the total weight of the coating composition in the wet-state—i.e., 60 wt. %×0.15=9 wt. % of pigment in the coating composition.

The coating composition may have a viscosity ranging from about 250 cps to about 10,000 cps as measured by a Brookfield viscometer at 10 RPM using a #4 spindle at room temperature—including all viscosities and sub-ranges there-between. In a preferred embodiment, the coating composition may have a viscosity ranging from about 600 cps to about 8,000 cps as measured by a Brookfield viscometer at 10 RPM using a #4 spindle at room temperature—including all viscosities and sub-ranges there-between. The coating composition may have a viscosity ranging from about 600 cps to about 8,000 cps as measured by a Brookfield viscometer at 10 RPM using a #4 spindle at room temperature—including all viscosities and sub-ranges there-between.

The monolithic structure 1000 of the present invention may be formed according to the following methodology. The coating composition of the present invention may be spray applied to either the first major surface 101 of the panel body 100 or the first major surface 201 of the facing layer 200. According to some embodiments, the spray application is performed with high pressure air or airless spraying. The term "high pressure air" refers to the coating composition being held at atmospheric pressure forced through a nozzle of a spray gun with the aid of compressed air, whereby the compressed air having a pressure of about 20 psi to about 100 psi—including all pressures and sub-ranges there-between. The term "airless spraying" refers to the coating composition being pressurized and forced through a nozzle of a spray gun, whereby the coating composition is pressurized a pressure of about 40 psi to about 800 psi—including all pressures and sub-ranges there-between. Upon leaving the nozzle of the spray gun in either embodiment, the coating composition is atomized.

The spray application of the coating composition may be performed at room temperature—which refers to the surrounding environment being at room temperature and/or the spray guns may be operated at room temperature. In other embodiments, the spray guns may be heated to a temperature above room temperature.

With the coating composition having low amounts of binder and the binder having a low Tg and/or low MFFT, once atomized, the coating composition begins to coalesce onto the filler present in the coating composition (e.g., pigment)—also referred to herein as "coalesced particles." The coalescing begins before the atomized coating composition reaches its intended target (i.e., either the panel body 100 or facing layer 200). Therefore, after leaving the nozzle of the spray gun, the binder within the atomized coating composition may partially or fully coalesce onto the filler (e.g., pigment) as a plurality of discrete coalesced particles prior to reaching the panel body 100 or the facing layer 200.

The phrase "coalesced particles" refers to solid or semi-solid particles comprised of the binder and filler (and any other non-liquid carrier component present in the coating composition)—whereby the binder has formed a film onto at least a portion of the outer surface of the filler (e.g., pigment0. The coalesced particles are substantially free of liquid carrier. The coalesced particles may have a particle size ranging from about 20 μm to about 1,000 μm—including all sizes and sub-ranges there-between.

In alternative embodiments, the coating composition may comprise a binder having a Tg above 0° C.) and/or a corresponding higher MFFT—however, such coating compositions are required to be sprayed using a spray gun that is heated to a temperature above room temperature during application. In another alternative embodiment, the coating composition may comprise a binder having a Tg as low as −60° C. and/or a MFFT of about −40° C.

With the binder in the atomized coating composition at least partially (if not fully) coalesces onto the filler to form a plurality of discrete particles prior to reaching the facing layer 200 and/or panel body 100, the result is a coating methodology that provides for application of self-supporting and coalesced particles to a desired major surface 101, 201, whereby the binder (and filler) does not form a closed film on the desired major surface 101, 201, but rather the binder forms discrete films on each separate filler (e.g., pigment) particle whereby the coalesced particles stack on each other, thereby forming an open and porous coating 300 layer. With the film formed by the binder being discrete and limited to separate particles (as compared to a film formed across the entire surface of a building panel surface), the voids between adjacent coalesced particles creates an acoustically transparent pathway for air to flow between the upper surface 301 and the lower surface 302 of the coating 300. While the voids between adjacent coalesced particles provides a tortuous pathway that allows for sufficient airflow for between the upper surface 301 and the lower surface 302 for the coating 300 to be acoustically transparent, the packing of the coalesced particles also creates a visual barrier that imparts non-uniform optical scattering, non-uniform gloss, and roughness to the coating 300. The resulting visual barrier allows the coating 300 to simultaneously hide otherwise visible 40 elements that would be present on the major surfaces 101, 201 of either the facing layer 200 or the panel body 100. Therefore, the coating 300 according to the present invention surprisingly provides ample acoustic transparency while simultaneously providing visual opacity.

The benefit of the dual acoustic and visual attributes of the coating 300 is that the coating 300 may be applied to at least the first major surface 201 of the facing layer 200 and/or the first major surface 101 of the panel body 100 to mask one or more visual imperfections present on such first major surfaces 101, 202 without substantially interfering with the airflow through the respective facing layer 200 and/or panel body 100. The phrase "substantially interfering" refers to the coating 300 not reducing airflow by more than 5% through either the facing layer 200 or panel body 100.

By being acoustically transparent while also being able to mask imperfections 40 that are otherwise visually apparent on the first major surface 101, 201 of the facing layer 200 and/or panel body 100, the coating 300 has an appearance that is continuous and uninterrupted while also being acoustically transparent—i.e., the coating 300 forms an acoustic monolithic surface 1001.

Figure 5:
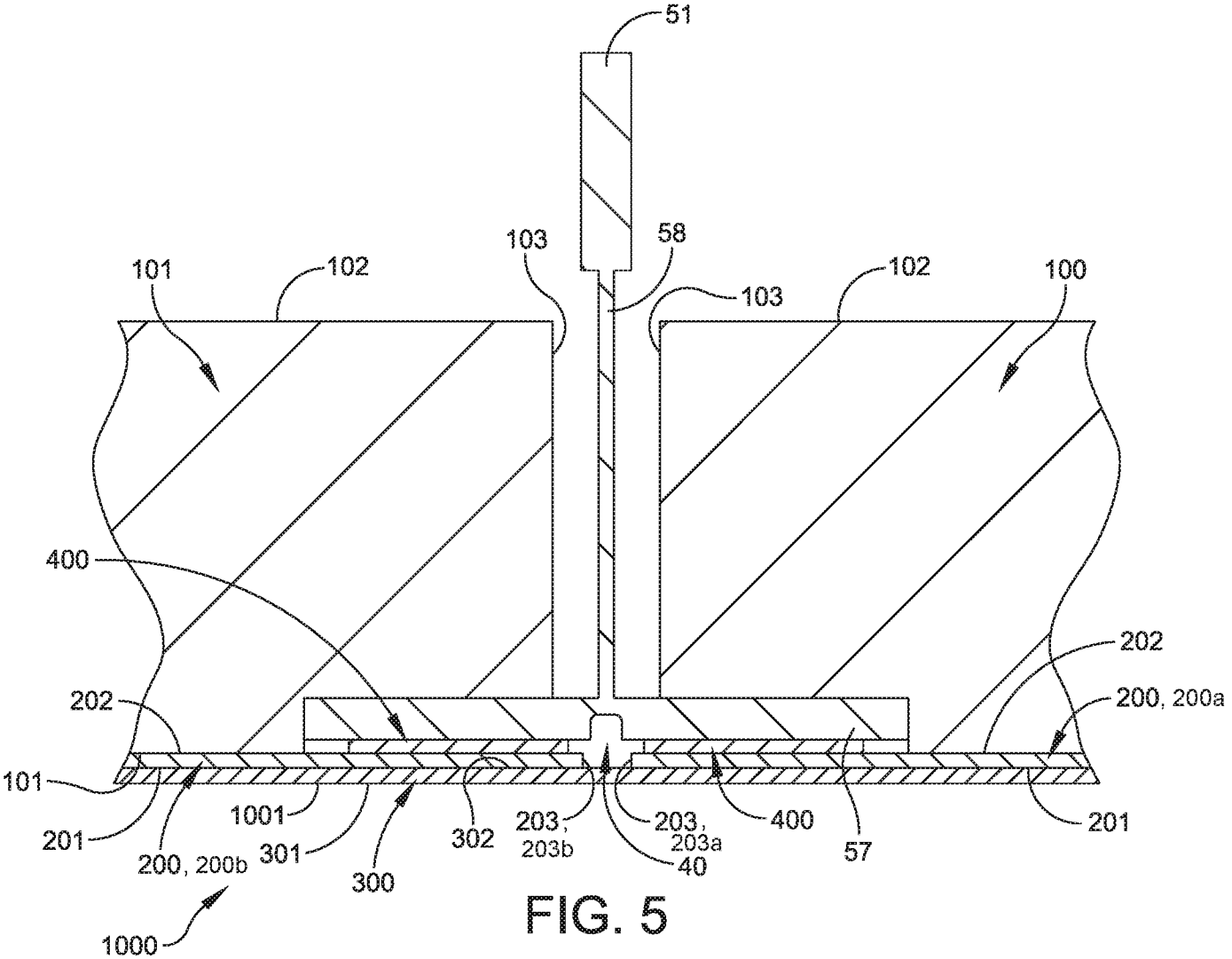
FIG. 5 is a close-up cross-sectional view of portion A of the building system of FIG. 4.

Referring now to FIGS. 4 and 5, the coating 300 may be suitable for creating a monolithic structure 1000 that includes a monolithic surface 1001 that spans across a plurality of panel bodies 100 and/or facing sheets 200. A building system 1 may comprise at least a first facing layer 200*a* and a second facing layer 200*b* arranged adjacent to each other such that a first side surface 203*a* of the first facing layer 200*a* is adjacent to a second side surface 203*b* of the second facing layer 200*b*. The first and second sides surfaces 203*a*, 203*b* may contact each other or may be offset from each other by a non-zero distance. A seam 40 may be formed between the first and second side surfaces 203*a*, 203*b*—whereby the seam 40 is visibly apparent when viewing the first major surfaces 201 of the facing layers 200 within the room environment 2. However, application of the coating 300 to the first and second facing layers 200*a*, 200*b* forms an uninterrupted layer that spans continuously from the first major surface 201 of the first facing layer 200*a*, across the seam 40, and onto the first major surface 201 of the second facing layer 200*b* such that the seam 40 is masked by the coating 300. By masking the seam 40, the coating 300 forms the monolithic surface 1001 of the monolithic structure 1000.

Such a seam 40 may be created using a wallpaper technique with a circular cutter that is offset at an angle to create a specific small gap between two different surfaces. The coating is designed to bridge such gaps as large as 0.7 mm, it is preferable for the gap to be <0.4 mm, and ideally as small as possible. An overlap needs to be avoided to prevent creation of a shadow.

The resulting monolithic structure 1000 may exhibit an NRC value as measured from the monolithic surface 1001 to a rear surface 1002 that ranges from about 0.5 to about 0.95—including all values and subranges. According to the present invention, the second major surface 102 of the panel body 100 may form the rear surface 1002 of the monolithic structure 1000. The resulting monolithic structure 1000 may exhibit an CAC value as measured from the monolithic surface 1001 to a rear surface 1002 that is at least 30 or greater, preferably 35 or greater.

The invention will be described in greater detail by way of specific examples. The following examples are offered for illustrative purposes and are not intended to limit the invention in any manner.

EXAMPLES

Experiment 1

A first experiment was performed to test the aesthetic characteristics of the coating of the present invention. This experiment was prepared by arranging a series of first and second scrims adjacent to each other, whereby a visible seam existed between each pair of the first and second scrims. Each pair of first and second scrims was spray-coated with a different the coating composition (as set forth in Example 1 and Comparative Examples 1-7). The spray-coating was performed at room temperature using a non-heated spray gun, and each coating composition was applied in the same amount across each seam of each respective pair of scrims. Once applied, the coated scrims were evaluated to determine if the respective coating was able to hide the seam between first and second scrims. The results are provided below in Table 1.

TABLE 1

| | Ex. 1 | Comp. Ex. 1 | Comp. Ex. 2 | Comp. Ex. 3 | Comp. Ex. 4 | Comp. Ex. 5 | Comp. Ex. 6 | Comp. Ex. 7 |
|---|---|---|---|---|---|---|---|---|
| Binder Tg | −22° C. | 16° C. | 12° C. | 10° C. | 10° C. | 7° C. | −4° C. | −10° C. |
| Solid's Content of Coating | 51% | 50% | 54% | 50% | 95% | 50% | 60% | 41% |
| Coating pH | 8.0 | 9.0 | 7.8 | 8.0 | 9.0 | 8.5 | 5.0 | 8.0 |
| Hide Seam | Y | N | N | N | N | N | N | N |

As demonstrated by Table 1, the only coating able to hide the seam formed between adjacent scrims was that having a binder with a Tg of less than −10° C. This is true even when using a solids content as low as 50%—which, as compared to higher solids' content coatings, would normally expect to provide the desired concealing aesthetic properties only provided by the coating of Ex. 1. Thus, using a binder having a Tg of less than −10° C. provides an unexpected improvement in seam concealment between two or more adjacent bodies.

Experiment 2

A second experiment was performed to test the airflow and aesthetic characteristics of the coating of the present invention. This second experiment was performed by applying spraying the coating composition of the present invention onto a non-woven fiberglass scrim having an initial air flow resistance of 20 mks rayls, whereby the acoustical and visual properties of the subsequently coated scrim are measured and recorded. The coatings applied to the scrim are formed using the following components:

Binder: acrylic copolymer having a Tg of −22° C.

$TiO_2$ Blend: blend of $TiO_2$ coated $CaCO_3$ particles and pure $TiO_2$ particles at a weight ration of about 1.44:1

Fiber: Micro Cellulose fiber

Liquid Carrier: Water

After application of each coating to the corresponding non-woven fiberglass scrim, the combination of coating and scrim was measured for the following:

(1) thickness from the upper surface of the coating to the second major surface of the scrim (i.e., the facing layer);

(2) the airflow resistance as measured from the upper surface of the coating to the second major surface of the scrim (i.e., the facing layer);

(3) application amount of the coating to the scrim; and (4) the 85° gloss measurements on the upper surface of the coating The formulation and test results are set forth below in Table 2.

TABLE 2

| | Binder (g) | Diatomaceous Earth (g) | $TiO_2$ Blend (g) | Aluminum Trihydrate (g) | Water (g) | Dry Amount ($g/m^2$) | Thickness (μm) | MKS Rayls | Log Rayls | 85 Degree Gloss | Surface Roughness (RMS) |
|---|---|---|---|---|---|---|---|---|---|---|---|
| Ex. 2 | 6.3 | 11.8 | 64.4 | 16.9 | 29.9 | 421.9 | 0.75 | 125.7 | 2.10 | 2.3 | 0.125 |
| Ex. 3 | 6.3 | 11.8 | 64.4 | 16.9 | 29.9 | 648.0 | 0.88 | 218.4 | 2.34 | 2.7 | 0.123 |
| Ex. 4 | 6.3 | 11.8 | 64.4 | 16.9 | 29.9 | 859.0 | 0.95 | 4,824.6 | 3.68 | 5.6 | 0.082 |
| Ex. 5 | 6.3 | 11.8 | 64.4 | 16.9 | 29.9 | 1307.8 | 1.29 | 14,043.0 | 4.15 | 3.4 | 0.108 |
| Ex. 6 | 3.6 | 12.2 | 66.7 | 17.4 | 29.9 | 442.4 | 1.09 | 59.3 | 1.77 | 0.6 | 0.21 |
| Ex. 7 | 3.6 | 12.2 | 66.7 | 17.4 | 29.9 | 871.9 | 1.14 | 172.3 | 2.24 | 1.6 | 0.176 |
| Ex. 8 | 3.6 | 12.2 | 66.7 | 17.4 | 29.9 | 1298.1 | 1.51 | 344.3 | 2.54 | 1.2 | 0.153 |
| Ex. 9 | 3.3 | 14.6 | 66.7 | 15.0 | 29.9 | 448.9 | 1.03 | 63.5 | 1.80 | 1.3 | 0.119 |
| Ex. 10 | 3.3 | 14.6 | 66.7 | 15.0 | 29.9 | 868.6 | 1.32 | 97.7 | 1.99 | 1.4 | 0.277 |
| Ex. 11 | 3.3 | 14.6 | 66.7 | 15.0 | 29.9 | 990.3 | 1.34 | 342.0 | 2.53 | 2.0 | 0.227 |
| Ex. 12 | 3.3 | 14.3 | 66.7 | 12.5 | 29.9 | 1314.3 | 1.66 | 205.0 | 2.31 | 1.7 | 0.302 |
| Ex. 13 | 6.1 | 14.3 | 66.7 | 12.5 | 29.9 | 434.9 | 0.89 | 168.6 | 2.23 | 1.8 | 0.07 |
| Ex. 14 | 6.1 | 14.3 | 66.7 | 12.5 | 29.9 | 868.6 | 0.93 | 5,097.3 | 3.71 | 9.3 | 0.069 |
| Ex. 15 | 6.1 | 14.3 | 66.7 | 12.5 | 29.9 | 1292.7 | 1.17 | 34,637.2 | 4.54 | 4.7 | 0.122 |

As demonstrated by Table 2, the coating of the present invention is able to impart the desired aesthetic properties while surprisingly not hindering the acoustical performance of the scrim. Furthermore, it has been surprisingly discovered that the application amount of the coating may be varied up to about 1,300 $g/m^2$ while still achieving the desired airflow resistance needed for the resulting monolithic structure to have the desired acoustical properties.

Additional acoustically transparent coatings may be formed using formulations include the pure $TiO_2$ present in an amount ranging from about 25.5 parts by weight to about 33.6 parts by dry-weight of the coating; the TiO2 coated CaCO3 particles present in an amount ranging from about 33.6 to about 39.4 parts by dry-weight of the coating; aluminum trihydrate present in an amount ranging from about 7.5 to about 17.4 parts by dry-weight of the coating; and diatomaceous earth in an amount ranging from about 11.4 to about 14.8 parts by dry-weight of the coating.

Another round of the second experiment was performed, whereby the filler was replaced with microfibers. The formulation and test results of this second experiment are set forth below in Table 3.

As demonstrated by Table 3, the even without the presence of a filler, the coating of the present invention is still able to impart the desired aesthetic properties while surprisingly not hindering the acoustical performance of the scrim. Furthermore, it has been surprisingly discovered that the application amount of these coatings may be varied up to about 1,300 $g/m^2$ while still achieving the desired airflow resistance needed for the resulting monolithic structure to have the desired acoustical properties.

Experiment 3

A third experiment was performed to test the impact of application amounts of the coating containing silica with respect to airflow resistance. This third experiment was performed by applying a number of different coating compositions onto a non-woven fiberglass scrim having an initial air flow resistance of 20 mks rayls, whereby the acoustical properties of the subsequently coated scrim are measured and recorded. The coatings applied to the scrim are formed using the following components:

TABLE 3

| | Binder (g) | Fiber (g) | Liquid Carrier (g) | Dry Amount ($g/m^2$) | Thickness (μm) | MKS Rayls | Log Rayls | 85 Degree Gloss | Surface Roughness (RMS) |
|---|---|---|---|---|---|---|---|---|---|
| Ex. 16 | 3.3 | — | 29.9 | 448.9 | 1.03 | 125.7 | 2.10 | 2.3 | 0.119 |
| Ex. 17 | 3.3 | — | 29.9 | 868.6 | 1.32 | 218.4 | 2.34 | 2.7 | 0.277 |
| Ex. 18 | 3.3 | — | 29.9 | 990.3 | 1.34 | 4,824.6 | 3.68 | 5.6 | 0.227 |
| Ex. 19 | 3.3 | — | 29.9 | 1314.3 | 1.66 | 14,043.0 | 4.15 | 3.4 | 0.302 |
| Ex. 20 | 3.3 | 4.0 | 29.9 | 420.9 | 1.08 | 59.3 | 1.77 | 0.6 | 0.224 |
| Ex. 21 | 3.3 | 4.0 | 29.9 | 861.1 | 1.23 | 172.3 | 2.24 | 1.6 | 0.167 |
| Ex. 22 | 3.3 | 4.0 | 29.9 | 936.5 | 1.26 | 344.3 | 2.54 | 1.2 | 0.163 |
| Ex. 23 | 3.3 | 4.0 | 29.9 | 1280.9 | 1.73 | 63.5 | 1.80 | 1.3 | 0.249 |
| Ex. 24 | 5.29 | — | 29.9 | 437.0 | 0.78 | 97.7 | 1.99 | 1.4 | 0.1196 |
| Ex. 25 | 5.29 | — | 29.9 | 861.1 | 0.93 | 342.0 | 2.53 | 2.0 | 0.059 |
| Ex. 26 | 5.29 | — | 29.9 | 1328.3 | 1.10 | 205.0 | 2.31 | 1.7 | 0.206 |
| Ex. 27 | 5.29 | 4.0 | 29.9 | 454.2 | 0.92 | 168.6 | 2.23 | 1.8 | 0.137 |
| Ex. 28 | 5.29 | 4.0 | 29.9 | 851.4 | 1.03 | 5,097.3 | 3.71 | 9.3 | 0.107 |
| Ex. 29 | 5.29 | 4.0 | 29.9 | 1304.6 | 1.24 | 34,637.2 | 4.54 | 4.7 | 0.06 |

Binder: acrylic copolymer having a Tg of −22° C.
Matting Agent ("MA"): Silica
Filler: Calcined Diatomaceous Earth
The results are set forth below in Table 4.

TABLE 4

| | Binder (g) | Filler (g) | MA (g) | Solid's Content | Coating Amount ($g/m^2$) | mks rayls |
|---|---|---|---|---|---|---|
| Ex. 30 | 3.5 | 12.0 | 2.3 | 71.9 | 441.3 | 1,779.0 |
| Ex. 31 | 3.5 | 12.0 | 2.3 | 71.9 | 409.0 | 188.6 |
| Ex. 32 | 3.5 | 12.0 | 5.55 | 69.8 | 655.5 | 118.6 |
| Ex. 33 | 3.5 | 12.0 | 5.55 | 69.8 | 801.9 | 361.3 |
| Ex. 34 | 3.5 | 12.0 | 5.55 | 69.8 | 861.1 | 526.0 |
| Ex. 35 | 3.5 | 12.0 | 5.55 | 69.8 | 432.7 | 102.7 |
| Ex. 36 | 3.5 | 12.0 | 5.55 | 69.8 | 655.5 | 118.9 |
| Ex. 37 | 3.5 | 12.0 | 5.55 | 69.8 | 801.9 | 361.3 |
| Ex. 38 | 3.5 | 12.0 | 5.55 | 69.8 | 861.1 | 526.0 |
| Ex. 39 | 3.3 | 12.0 | 5.55 | 71.0 | 1,184.0 | 254.4 |
| Ex. 40 | 3.3 | 12.0 | 5.55 | 71.0 | 861.1 | 140.3 |

As demonstrated by Table 4, the coating composition of the present invention provides an unexpected and vast improvement in airflow resistance when the coating contains silica. Specifically, as demonstrated by Example 39, when the coating composition of the present invention comprises silica in at least a 1:1 ratio relative to the binder, the resulting coating composition may be applied in an amount that is almost three times greater than a coating having less than 1:1 ratio of silica (e.g., Example 30) without experiencing a substantial increase in airflow resistance. Stated otherwise, the addition of silica to the coating in an amount of greater than 1:1 relative to the binder provides an unexpected improvement in reduction of airflow resistance at high application amounts—which is particularly useful when creating an acoustically transparent coating that must also conceal seams and defects of the underlying surface.

Experiment 4

A fourth experiment was performed to test the impact of increased solid's content in the coating with respect to binder selection and airflow resistance. This third experiment was performed by applying a number of different coating compositions onto a non-woven fiberglass scrim having an initial air flow resistance of 20 mks rayls, whereby the acoustical properties of the subsequently coated scrim are measured and recorded. The coatings applied to the scrim are formed using the following components:

Binder: acrylic copolymer having a Tg of −22° C.
Matting Agent ("MA"): Silica
Filler: Calcined Diatomaceous Earth
The results are set forth below in Table 4.

TABLE 4

| | Binder (g) | Filler (g) | MA (g) | Solid's Content | Coating Amount ($g/m^2$) | mks rayls |
|---|---|---|---|---|---|---|
| Ex. 30 | 3.5 | 12.0 | 2.3 | 71.9 | 441.3 | 1,779.0 |
| Ex. 31 | 3.5 | 12.0 | 2.3 | 71.9 | 409.0 | 188.6 |
| Ex. 32 | 3.5 | 12.0 | 5.55 | 69.8 | 655.5 | 118.6 |
| Ex. 33 | 3.5 | 12.0 | 5.55 | 69.8 | 801.9 | 361.3 |
| Ex. 34 | 3.5 | 12.0 | 5.55 | 69.8 | 861.1 | 526.0 |
| Ex. 35 | 3.5 | 12.0 | 5.55 | 69.8 | 432.7 | 102.7 |
| Ex. 36 | 3.5 | 12.0 | 5.55 | 69.8 | 655.5 | 118.9 |
| Ex. 37 | 3.5 | 12.0 | 5.55 | 69.8 | 801.9 | 361.3 |
| Ex. 38 | 3.5 | 12.0 | 5.55 | 69.8 | 861.1 | 526.0 |
| Ex. 39 | 3.3 | 12.0 | 5.55 | 71.0 | 1,184.0 | 254.4 |
| Ex. 40 | 3.3 | 12.0 | 5.55 | 71.0 | 861.1 | 140.3 |

As demonstrated by Table 4, the coating composition of the present invention provides an unexpected and vast improvement in airflow resistance when the coating contains silica. Specifically, as demonstrated by Example 39, when the coating composition of the present invention comprises silica in at least a 1:1 ratio relative to the binder, the resulting coating composition may be applied in an amount that is almost three times greater than a coating having less than 1:1 ratio of silica (e.g., Example 30) without experiencing a substantial increase in airflow resistance. Stated otherwise, the addition of silica to the coating in an amount of greater than 1:1 relative to the binder provides an unexpected improvement in reduction of airflow resistance at high application amounts—which is particularly useful when creating an acoustically transparent coating that must also conceal seams and defects of the underlying surface.

What is claimed is:

1. A coated acoustic building material comprising:
a body comprising a first major surface opposite a second major surface;
a coating having an upper surface opposite a lower surface, the lower surface of the coating facing the first major surface of the body, the coating comprising:
polymeric binder having a glass transition temperature less than 0° C.; and
a filler;
wherein the coating is present as coalesced particles atop the first major surface in an amount ranging from about 210 $g/m^2$ to about 1,300 $g/m^2$.

2. The coated acoustic building material according to claim 1, wherein the glass transition temperature is less than −20° C.

3. The coated acoustic building material according to claim 1, wherein the polymeric binder is present in an amount ranging from about coating has 1 wt. % to about 10 wt. %.

4. The coated acoustic building material according to claim 1, wherein the coated acoustic building material further comprises a non-woven layer having an upper surface opposite a lower surface, the non-woven layer positioned between the body and the coating such that the lower surface of the non-woven layer faces the first major surface of the body and the upper surface of the non-woven layer faces the coating.

5. The coated acoustic building material according to claim 4, wherein a thickness as measured from the lower surface of the non-woven layer to the upper surface of the coating ranges from about 0.5 μm to about 5.0 μm.

6. The coated acoustic building material according to claim 4, wherein the non-woven layer comprises inorganic fibers.

7. The coated acoustic building material according to claim 1, wherein the coated building material exhibits an NRC value ranging from about 0.5 to about 0.9 as measured from the second major surface of the body to the upper surface of the coating.

8. The coated acoustic building material according to claim 1, wherein the body comprises inorganic fibers.

9. An acoustic building system comprising:

a first building panel comprising a first major surface defined by a first perimeter, and a second building panel comprising a second major surface defined by a second perimeter, at least a first portion of the first perimeter being immediately adjacent to a second portion of the second perimeter, whereby a seam exists between the first portion and the second portion;

a coating applied to the first major surface and the second major surface such that the coating covers at least a portion of the seam;

wherein the coating comprises polymeric binder having a glass transition temperature less than 0° C. and a filler, and wherein the coating is present as coalesced particles atop the first major surface in an amount ranging from about 210 $g/m^2$ to about 1,300 $g/m^2$.

10. The acoustic building system according to claim 9, wherein the glass transition temperature is less than −20° C.

11. The acoustic building system according to claim 9, wherein the polymeric binder is present in an amount ranging from about coating has 1 wt. % to about 10 wt. %.

12. The acoustic building system according to claim 9, wherein the first building panel further comprises a non-woven layer having an upper surface opposite a lower surface, the non-woven layer positioned between the first building panel and the coating such that the lower surface of the non-woven layer faces the first major surface of the first building panel and the upper surface of the non-woven layer faces the coating.

13. The acoustic building system according to claim 12, wherein the non-woven layer has a first airflow resistance ranging from about 20 mks rayls to about 500 mks rayls as measured between lower surface and the upper surface of the non-woven layer.

14. The acoustic building system according to claim 12, wherein the non- woven layer and the coating exhibit a second airflow resistance ranging from about 40 mks rayls to about 7,500 mks rayls as measured between the lower surface of the non-woven layer to the upper surface of the coating.

15. The acoustic building system according to claim 9, wherein the coating forms a monolithic appearance across the seam between the first and second building panels.

16. A coated acoustic building material comprising:

a non-woven layer having an upper surface opposite a lower surface;

a coating having an upper surface opposite a lower surface, the lower surface of the coating facing the upper surface of the non-woven layer, the coating comprising:

polymeric binder having a glass transition temperature less than −20° C.; and a filler;

wherein the coating is present as coalesced particles atop the upper surface of the non- woven layer and an airflow resistance ranges from about 40 mks rayls to about 7,500 mks rayls as measured between the lower surface of the non-woven layer and the upper surface of the coating.

17. The coated acoustic building material according to claim 16, wherein the glass transition temperature is less than −22° C. and the polymeric binder is an acrylic copolymer.

18. The coated acoustic building material according to claim 16, wherein the polymeric binder is present in an amount ranging from about coating has 1 wt. % to about 10 wt. %.

19. The coated acoustic building material according to claim 16, wherein the non-woven layer is at least partially visually masked by the coating.

20. The coated acoustic building material according to claim 16, wherein the coated acoustic building material further comprises a body having a first major surface opposite a second major surface, wherein the lower surface of the non-woven layer faces the first major surface of the body.

* * * * *